United States Patent [19]

Howse, Jr. et al.

[11] Patent Number: 4,457,883

[45] Date of Patent: Jul. 3, 1984

[54] NYLON SPIN-TEXTURE PROCESS

[75] Inventors: Paul T. Howse, Jr., Pensacola, Fla.; Byron E. Beasley, St. Louis, Mo.; M. Allan Jacques, Cantonment; Rupert J. Snooks, Jr., Gulf Breeze, both of Fla.

[73] Assignee: Monsanto Company, St. Louis, Mo.

[21] Appl. No.: 444,008

[22] Filed: Nov. 23, 1982

[51] Int. Cl.[3] ..... D01D 5/22

[52] U.S. Cl. ..... 264/168; 264/210.8; 264/211

[58] Field of Search ..... 264/211, 176 F, 210.8, 264/168

[56] References Cited

U.S. PATENT DOCUMENTS

| | | | |
|---|---|---|---|
| 3,529,929 | 9/1970 | Page et al. | 23/88 |
| 3,755,221 | 8/1973 | Hitch | 260/18 N |
| 4,176,227 | 11/1979 | Baggett et al. | 528/488 |
| 4,202,854 | 5/1980 | Howse et al. | 264/168 |
| 4,271,233 | 6/1981 | Plischke et al. | 428/370 |
| 4,280,860 | 7/1981 | Shen et al. | 264/168 |
| 4,293,614 | 10/1981 | Plischke et al. | 428/374 |
| 4,301,102 | 11/1981 | Fernstrom et al. | 264/168 |

FOREIGN PATENT DOCUMENTS

| | | | |
|---|---|---|---|
| 41-15252 | 8/1966 | Japan | 264/24 |

*Primary Examiner*—Jay H. Woo
*Attorney, Agent, or Firm*—John W. Whisler

[57] ABSTRACT

In producing nylon yarns having latent crimp by the process disclosed in U.S. Pat. No. 4,202,854, the polymer throughput (i.e. extrusion rate) is increased without sacrificing the amount of uniformity of the bulk resulting from development of the latent crimp by adding a nucleating agent, such as calcium fluoride, to the nylon prior to extrusion.

3 Claims, No Drawings

NYLON SPIN-TEXTURE PROCESS

BACKGROUND OF THE INVENTION

A. Field of the Invention

This invention relates to an improvement in a spin-texture process and, more particularly, to the process described in U.S. Pat. No. 4,202,854 for producing monocomponent polyamide yarn having latent crimp. The improvement provides for increased polymer throughput rates without sacrificing the amount or uniformity of the bulk resulting from development of the latent crimp.

B. Description of the Prior Art

U.S. Pat. No. 4,202,854 relates to a spin-texture process for producing multifilament polyamide yarn having a helical latent crimp. The process comprises extruding molten polyamide through a spinneret at a given rate (i.e. throughput) to provide a monocomponent multifilament yarn that is quenched, passed around a feed roll (e.g. driven feed roll and its associated idler roll) with a given number of wraps, and drawn as it leaves the feed roll. The filaments are subsequently collected, for example, by being wound onto a bobbin. The process is characterized in that the feed roll is heated to a temperature between 100° C. and 175° C., the filaments are drawn at a draw ratio ranging from greater than 1.0 and less than 4.0 (e.g. 1.25 to 3.25), and the throughput, temperature of the feed roll, number of wraps taken by the yarn around the feed roll, and draw ratio are correlated to provide a yarn having an optimum amount of bulk upon development of the latent crimp. It is desirable for economic reasons that the process be operated at the highest possible polymer throughputs. Unfortunately, the process described in the patent is "throughput limited", that is, for any given spinneret there is a maximum throughput, beyond which the latent crimp imparted to the yarn by the process and, therefore, the bulk level of the yarn upon development of this latent crimp fluctuates and cannot be controlled. At throughputs below this maximum throughput unexpected fluctuations in the latent crimp (and bulk level) can easily be controlled (eliminated) by changing processing conditions, e.g., feed roll temperature, draw ratio, etc. For commercial operations, the bulk level of the yarn must be capable of being controlled within relatively narrow limits so as to avoid wide variations in bulk along the length of the yarn. Another problem encountered in operating the process at high throughputs is that the bulk level of the resulting yarn upon development of the latent crimp is too low (i.e., below 20%) for certain carpet yarn applications.

SUMMARY OF THE INVENTION

It is an object of the present invention to provide an improvement in the spin-texture process described in U.S. Pat. No. 4,202,854 whereby high polymer throughput rates can be used without losing either the ability to control the bulk level of the yarn or the ability to provide a yarn having a bulk level in excess of 20%.

This and other objects of the invention are accomplished by incorporating a nucleating agent into the polyamide from which the yarn is produced in an amount sufficient to provide yarn having, upon development of the latent crimp, a uniform bulk and, where desirable, a bulk level in excess of 20%. The improvement of the present invention permits the use of high polymer throughputs which would otherwise result in yarn of unacceptable bulk.

As used herein and in the attached claims the term "% bulk" is determined by the formula: % bulk$=(L_1-L_2/L_1)\times 100$, where $L_1$ is the length of a sample of yarn before development of the latent crimp and $L_2$ is the length of the same yarn ($L_1$ after the latent crimp has been developed by subjecting the length of yarn to 180° C. dry heat for five minutes followed by cooling of the yarn at ambient temperature for one minute). Then, the length of the yarn is again measured ($L_2$), stressed at 0.0009 gpd (grams per denier) load, 30 seconds after cooling.

DETAILED DESCRIPTION OF THE PREFERRED EMBODIMENTS OF THE INVENTION

The spin-texture process for producing polyamide yarns having latent crimp to which the improvement of this invention relates is described in U.S. Pat. No. 4,202,854. Accordingly, the disclosure of U.S. Pat. No. 4,202,854 is incorporated herein by reference. In general, the process comprises extruding a molten fiber-forming polyamide at a given throughput to form a monocomponent polyamide multifilament yarn. The yarn before being collected is passed around a heated feed roll (100° to 175° C.) and its associated separator roll with a plurality of wraps and then drawn as it leaves the feed roll at a draw ratio between about 1.25 and 3.25. The throughput, temperature of the feed roll, number of wraps, and draw ratio are correlated to provide a yarn having, upon development of the latent crimp, an optimum bulk level. From the standpoint of commercial yarns, polyhexamethylene adipamide (nylon 66) and polycaprolactam (nylon 6) are preferred fiberforming polyamides with nylon 66 being praticularly preferred.

Calcium fluoride has been found to be a particularly effective nucleating agent for use in practicing the invention. In general, sufficient nucleating agent must be added to produce the desired latent crimp and bulk characteristics. However, the concentration of the nucleating agent in the polyamide should not be so high as to cause spinning difficulties, such as denier variation. The optimum concentration of nucleating agent to be used in each instance will depend on factors, such as spinning conditions, the particular polyamide being used to form the yarn, and the particular nucleating agent being used, and can easily be determined experimentally by one skilled in the art without undue burden. When using calcium fluoride as the nucleating agent and nylon 66 as the polyamide, the concentration of calcium fluoride can vary over a wide range, for example, 10–1500 ppm, based on the weight of the nylon 66.

According to a preferred embodiment of the invention, the concentration of nucleating agent is correlated with the temperature of the heated feed roll, number of wraps taken by the yarn around the heated feed roll, and draw ratio to permit the highest possible polymer thoughput to be used with the spin-texture process. In general, increasing either the draw ratio or the number of wraps from a low value while holding all other processing variables constant causes the latent crimp (and bulk) level of the yarn to increase to a maximum value and thereafter decrease. Of course, in general, the temperature of the heated feed roll is inversely proportional to the residence time of the yarn on the feed roll as determined by the number of wraps taken by the yarn around the feed roll, the less is the number of wraps required to achieve the same bulk level.

EXAMPLE

In this example yarns are prepared utilizing the improvement of the present invention.

The following procedure is used to prepare each yarn. Fiber-forming nylon 66 (polyhexamethylene adipamide) of commercial grade and containing the amount of calcium fluoride specified in the Table is extruded through a 95-hole spinnerete having orifices of trilobal cross-section into a conventional melt spinning chimney measuring approximately 6 feet in length. The chimney is adapted to receive a cross-flow of cooling air at ambient conditions. After solidification in the chimney, the filaments are passed from the chimney over a conventional driven finish applicator roll. The filaments converge on the finish roll where a conventional aqueous finish is applied thereto and then are passed immediately over and around an electrically heated driven feed roll and its associated separator roll with several wraps. The yarn is passed from the feed roll over and around a driven draw roll and its associated separator roll with several wraps. The yarn is then passed from the draw roll through a fluid interlacing (tangling) device utilizing heated air to insert tangle into the yarn and finally is wound onto a bobbin. The specific conditions used in preparing each yarn along with the amount of bulk and tangle imparted to each yarn are given in the table.

TABLE

| | Control Yarn | Yarn 1 | Yarn 2 | Yarn 3 | Yarn 4 |
|---|---|---|---|---|---|
| Calcium fluoride in polymer (ppm) | 0 | 87.5 | 44 | 750 | 1500 |
| Polymer throughput (lbs/hr) | 56 | 56 | 56 | 56 | 56 |
| Extrusion temp. (°C.) | 286 | 284 | 284 | 285 | 285 |
| Quenching Air | | | | | |
| Flow (cfm) | 420 | 420 | 470 | 320 | 320 |
| Temperature (°C.) | Ambient | Ambient | Ambient | Ambient | Ambient |
| Finish Roll | | | | | |
| Speed (rpm) | 14.5 | 14.5 | 14.5 | 15 | 15 |
| Peripheral Spd (ypm) | 10 | 10 | 10 | 10.3 | 10.3 |
| Feed Rolls | | | | | |
| Peripheral Spd (ypm) | 1430 | 1250 | 1250 | 1430 | 1430 |
| Temperature (°C.) | 140 | 140 | 140 | 140 | 140 |
| Wraps | 5 | 5 | 5 | 5 | 5 |
| Draw Rolls | | | | | |
| Peripheral Spd (ypm) | 2510 | 2510 | 2500 | 2510 | 2510 |
| Temperature | 110 | 110 | 110 | 110 | 110 |
| Wraps | 8 | 8 | 8 | 8 | 8 |
| Draw Ratio | 1.76 | 2.0 | 2.0 | 1.76 | 1.76 |
| Tagling Device | | | | | |
| Fluid Pressure (psig) | 160 | 160 | 160 | 160 | 160 |
| Fluid Temp. (°C.) | 260 | 260 | 260 | 260 | 260 |
| Winding | | | | | |
| Tension (g) | 95 | 80 | 95 | 80 | 80 |
| Speed (ypm) | 2190 | 2166 | 2103 | 2070 | 2070 |
| Yarn Denier | 1935 | 1974 | 2056 | 1861 | 1852 |
| Yarn Bulk (%) | erratic | 26.1 | 25.9 | 23.6 | 26.0 |
| Yarn Tangle (t/mtr) | 17.7 | 18.0 | 17.4 | 20.3 | 18.3 |

The bulk level of the control yarn was erratic in that from time to time it would run along at a level of about 17%, and then without any warning, the bulk would suddenly jump from the 17% level to a higher level (about 25%) and, thereafter, gradually fall off to its initial 17% level. During the run, the bulk level of the control yarn was non-responsive to processing changes. In contrast, the bulk level of Yarns 1–4 was easily controllable to the level indicated in the Table. Operation of the spin-texture process at higher polymer throughputs in accordance with the present invention represents a significant improvement in the economics of the process.

What is claimed is:

1. In a process for producing a nylon 66 yarn having latent crimp wherein molten fiber-forming nylon 66 is extruded throughput through a spinneret to provide a monocomponent multifilament yarn that is quenched, passed with a given number of wraps around a feed roll and its associated idler roll, wherein the feed roll is heated to a temperature ranging from 100° to 175° C. and drawn a draw ratio ranging from 1.25 to 3.25 before being collected, wherein the latent crimp level of the yarn is controlled by making adjustments in the throughput, temperature of the feed roll, number of wraps and/or draw ratio and wherein there is a maximum throughput beyond which the latent crimp is no longer capable of being controlled by making said adjustments, the improvement of increasing said maximum throughput by incorporating calcium fluoride into the nylon 66 prior to extrusion.

2. The process of claim 1 wherein said temperature is between 125° and 175° C.

3. The process of claim 1 wherein the calcium chloride is present in an amount ranging from 10 to 1500 ppm, based on the weight of said nylon 66.

* * * * *